US006427642B1

(12) United States Patent
Beer et al.

(10) Patent No.: US 6,427,642 B1
(45) Date of Patent: Aug. 6, 2002

(54) CYLINDER HEAD FOR A WATER-COOLED INTERNAL COMBUSTION ENGINE

(75) Inventors: Michael Beer, Wimsheim; Albrecht Reustle, Walheim, both of (DE)

(73) Assignee: Dr. Ing. h.c.F. Porsche AG, Weissach (DE)

( * ) Notice: Subject to any disclaimer, the term of this patent is extended or adjusted under 35 U.S.C. 154(b) by 0 days.

(21) Appl. No.: 09/659,748

(22) Filed: Sep. 11, 2000

(30) Foreign Application Priority Data

Sep. 9, 1999 (DE) ..... 199 43 003

(51) Int. Cl.[7] ..... F02F 1/36
(52) U.S. Cl. ..... 123/41.82 R
(58) Field of Search ..... 123/41.74, 41.82 R, 123/41.72

(56) References Cited

U.S. PATENT DOCUMENTS

| | | | | |
|---|---|---|---|---|
| 2,305,475 A | | 12/1942 | Jagersberger et al. | 123/41.73 |
| 4,889,079 A | | 12/1989 | Takeda et al. | |
| 5,379,729 A | | 1/1995 | Yonezwa et al. | |
| 5,799,627 A | * | 9/1998 | Dohn et al. | 123/41.82 R |
| 5,890,461 A | * | 4/1999 | Iikura | 123/41.82 R |
| 5,983,843 A | | 11/1999 | Suzuki et al. | |

FOREIGN PATENT DOCUMENTS

| | | | | |
|---|---|---|---|---|
| DE | 1064289 | | 8/1959 | |
| DE | 2037315 | | 2/1972 | |
| DE | 3412052 | | 6/1986 | |
| DE | 3802886 | | 8/1988 | |
| DE | 19508113 | | 9/1996 | |
| DE | 19644409 | | 1/1998 | |
| EP | 0 088 157 | | 9/1983 | |
| EP | 0 353 988 | | 2/1990 | |
| FR | 1006447 | | 4/1952 | |
| GB | 583652 | | 12/1946 | |
| GB | 706974 | | 4/1954 | |
| GB | 766187 | * | 1/1957 | 123/41.82 R |

* cited by examiner

*Primary Examiner*—Noah P. Kamen
(74) *Attorney, Agent, or Firm*—Crowell & Moring LLP

(57) ABSTRACT

A cylinder head for a water-called internal combustion engine has a combustion space. Due to radiant heat in the combustion space, a hot site develops at a wall in a cooling duct of the cylinder head, through which cooling water is flowing. Control measures are provided for a concerted flow of cooling water in the cooling duct and for cooling the hot site at the wall of said cooling duct.

5 Claims, 2 Drawing Sheets

CYLINDER HEAD FOR A WATER-COOLED INTERNAL COMBUSTION ENGINE

BACKGROUND AND SUMMARY OF THE INVENTION

This application claims the priority of German Patent Document 199 43 003.9, filed Sep. 9, 1999, the disclosure of which is expressly incorporated by reference herein.

The invention relates to a cylinder head for a water-cooled internal combustion engine which in use has at least one hot site caused by radiant heat of a combustion space at a wall of the cylinder head.

A cylinder head for a valve-controlled internal combustion engine with water cooling is known from European Patent Document EP 0088 157 A 1 and comprises cylinder head measures for decreasing thermal loads. For this purpose, a nozzle-like main water crossing is provided, which produces a flow acting between exhaust and refill ducts.

In FIG. 3, the European Patent Document EP 0353988 A1 shows a cylinder head, which is water cooled and has a hot site in the region of one wall of the cylinder head. The hot site extends between a central spark plug and a combustion space.

Finally, U.S. Pat. No. 2,305,457 deals with a water-cooled cylinder head with cooling ducts, which are taken around the outlet valves. These cooling ducts have walls in the vicinity of the outlet valves, which are cooled by means of a cooling medium distributed over spray nozzles.

It is an object of the invention, to configure a cooling duct of a cylinder head of an internal combustion engine in such a manner, that especially pronounced hot sites of the cylinder head are supplied over the cooling duct with flowing cooling water.

Pursuant to the invention, this objective is accomplished by providing a cylinder head for a water-cooled internal combustion engine which in use has at least one hot site brought about by radiant heat of a combustion space at a wall of the cylinder head. The hot site is cooled by means of a cooling duct through which cooling water is flowing, wherecontrol structure is provided in the cooling duct at the wall of the cylinder head for forming a concerted flow of cooling water for cooling the hot site.

The advantages mainly achieved with the invention are that the control measures in the cooling duct of a cylinder head, consisting of a like metal alloy, bring about a concerted flow of cooling water in the region of the hot site, that is, at the wall of the cooling duct, which extends, for example, between a central spark plug and a combustion space. The control measures are particularly effective if they are provided adjacent to the hot site in the cooling duct, in that the cooling water, as a transverse flow, flows from the outlet side to the inlet side. In each burner space, the control measures are formed by a guiding rib and by locking ribs in the cooling duct. The guiding rib and locking ribs bring about a concerted flow of the cooling water at the hot site and reduce the risk of temperature-induced excessive stress. In turn, this makes it possible, on the one hand, to use standard materials (AlSi 10 or AlSi 7) for the structural design of a cylinder head and, on the other, to reduce clearly the number of defective units, which are particularly costly especially in the case of cylinder heads of internal combustion engines.

Other objects, advantages and novel features of the present invention will become apparent from the following detailed description of the invention when considered in conjunction with the accompanying drawings.

DETAILED DESCRIPTION OF THE DRAWINGS

Figure 1:
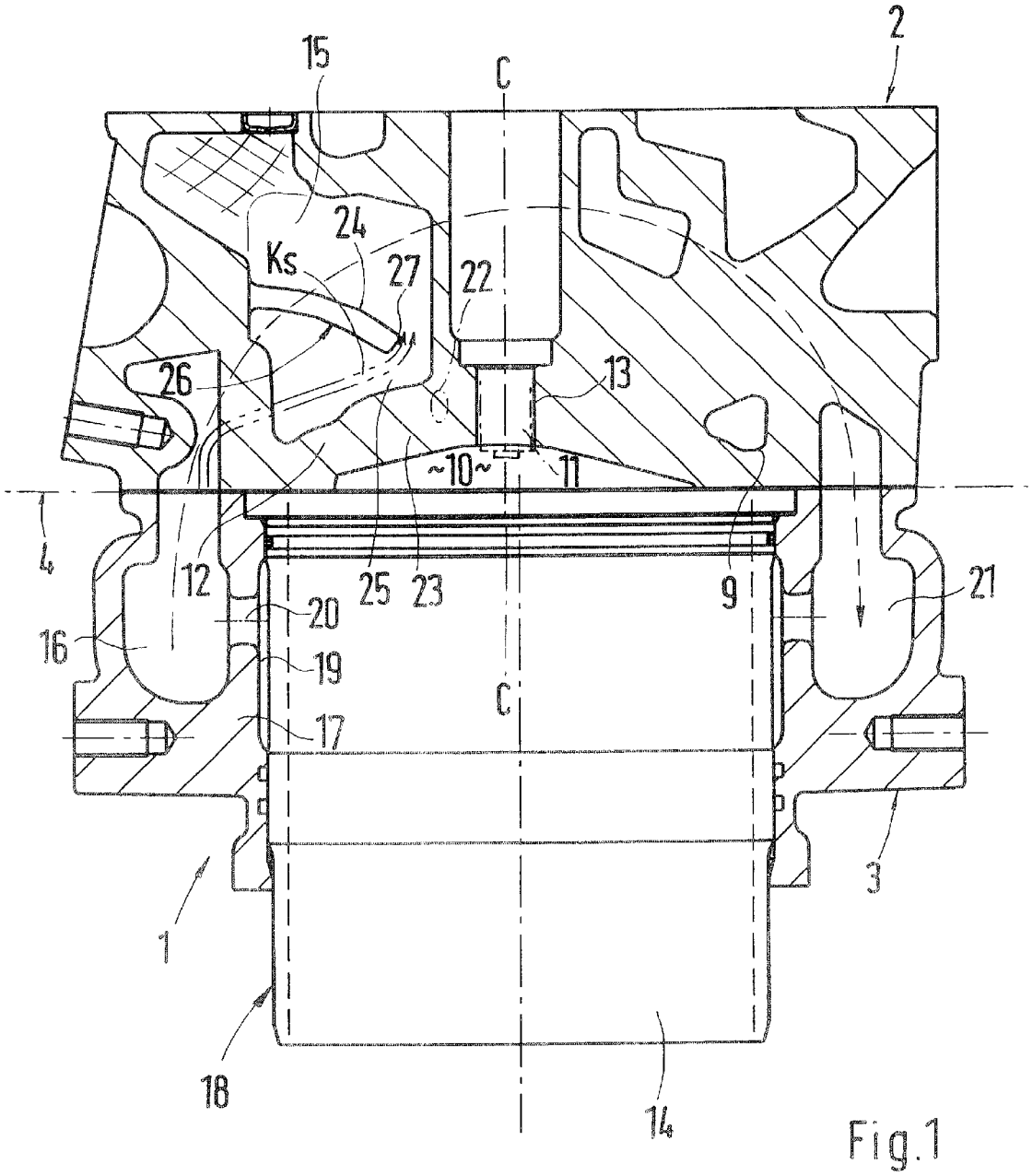
FIG. 1 shows a cross-section of an internal combustion engine in the area of a cylinder head and of a cylinder housing, constructed according to a preferred embodiment of the present invention.
Figure 2:
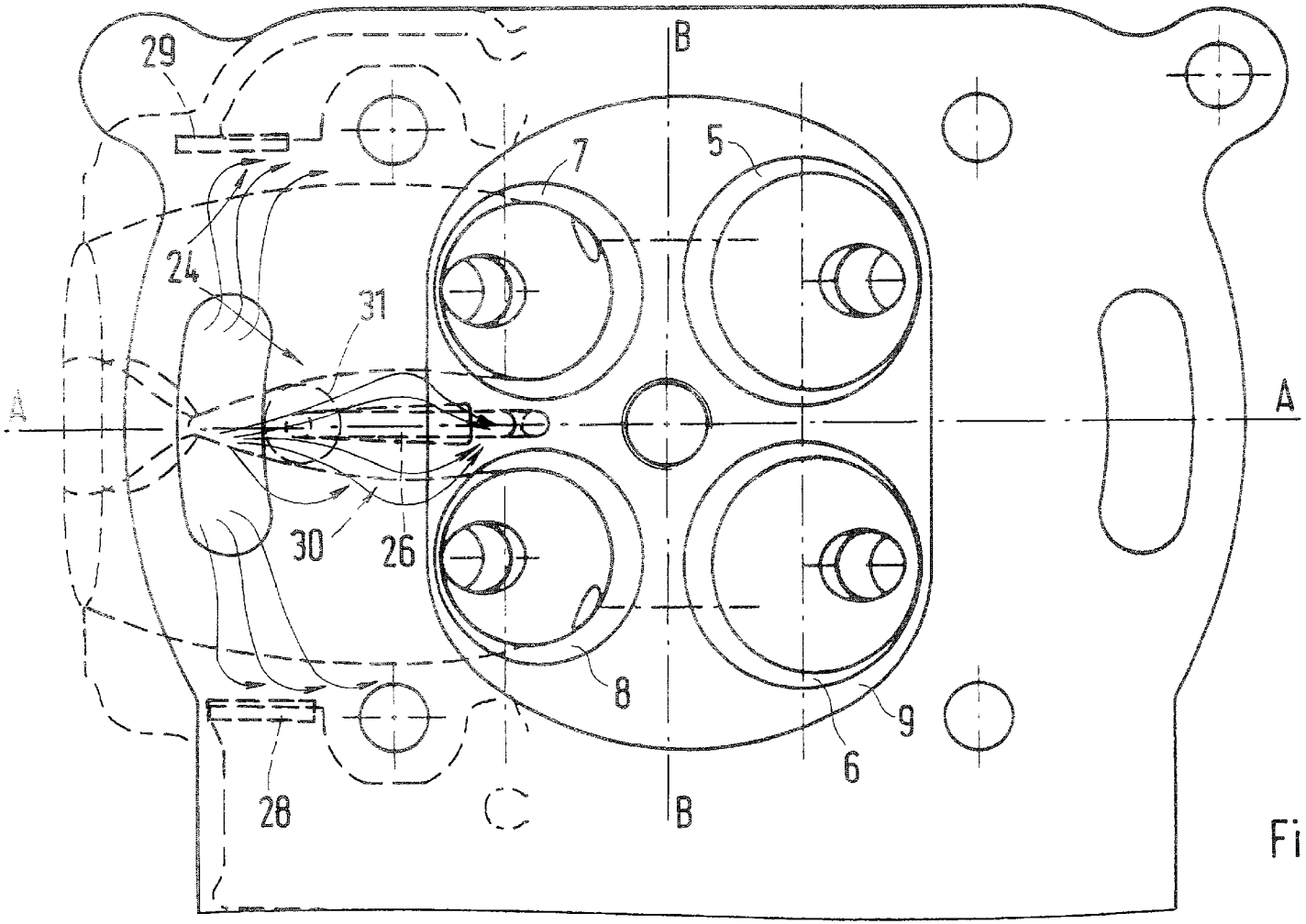
FIG. 2 shows a view from below FIG. 1, however, without the cylinder housing.

In the region shown, a multi-cylinder internal combustion spark-ignition engine 1 with a carburetor and water cooling comprises a cylinder head 2 and a cylinder housing 3, which are formed of a light metal alloy and are assembled in a parting plane 4. Per cylinder, the cylinder head 2 is provided with two inlet valves and two outlet valves (not shown), which interact with their valve disks with valve seats 5,6 and 7,8. The valves seats 5,6 have a larger diameter than the valve seats 7,8. The valve seats 5,6 interact with the inlet valves and the valve seats 7,8 interact with the outlet valves. In addition, the valve seats 5 and 6, as well as the valve seats 7 and 8, are disposed with their associated inlet valves and outlet valves on either side of a transverse plane A—A, which extends at right angles to a central longitudinal plane B—B of the cylinder head. A fuel-air mixture is supplied over the inlet valves of an inlet side 9 by a manifold injection to a combustion space 10 and ignited by means of a spark plug 11, after which it passes through the outlet valves of an outlet side 12 and reaches the exhaust equipment, which is not shown. The spark plug 11, which is screwed into a threaded borehole 13 of the cylinder head 2, extends in a central longitudinal plane C—C of a cylinder 14 or, at a slight distance therefrom, that is, it occupies a central position in the combustion space 10.

In the cylinder head 2, which is cooled with cooling water, a cooling duct 15 is provided for each combustion space 10 or cylinder 14. The cooling duct 15 is supplied with the cooling water from a first longitudinal duct 16 of the cylinder housing 3. The longitudinal duct 16, together with the cylinder wall 17, forms the boundary of a cylinder liner 18 of the cylinder 14 and does so, moreover, locally with the formation of an annular space 19, which is connected with the longitudinal duct 16 for the entry of cooling water over an opening 20. The cooling water flows from the outlet side 12 from the longitudinal duct 16 over the cooling duct 15 to the inlet side 9, which brings about a transverse flow in the cylinder head 2. The cooling water is discharged through a second longitudinal duct 21 of the cylinder head 2.

During the operation of the internal combustion engine 1, a hot site 22 develops due to radiant heat of the combustion space 10 in the cooling duct 15 at a wall 23, which forms the boundary of the threaded borehole 13 and the combustion space 10. In order to ensure concerted cooling of this hot site 22, control measures 24 are disposed in the cooling duct 15 of the section head 2 on the outlet side 12. With these control measures 24, the cooling water flows past the hot site 22 concertedly in a manner such that the thermal stress on the wall 23 of the cylinder head 2 is reduced. The control measures 24 are effective at 25, that is, adjacent to the hot site 22, and are formed by a guiding rib 26. This guiding rib 26 has a deflecting edge 27, which produces an accelerated flow Ks of cooling water, shown by lines of dots and dashes.

The guiding rib 26 extends in the transverse plane A—A between the outlet valves so that a very effective stream of cooling water is produced with the guiding rib 26. In addition, in the cooling duct 15, the control devices 24 comprise two locking ribs 28, 29, which are disposed, as seen in the transverse direction A—A, at a distance from one another and extend symmetrically on either side of the guiding rib 26. Finally, a combustion space support 30, in which a borehole 31 is provided, is disposed in the cooling duct 15. This borehole 31 contributes to the efficiency of the stream of cooling water especially in the region of the hot site 22.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An internal combustion engine assembly comprising:

a cylinder housing, a cylinder head connected to the cylinder housing, a spark plug disposed in the cylinder head in a position centrally of a cylinder formed opening of the cylinder housing, a pair of outlet valves disposed in the cylinder head and facing the cylinder opening at a first side of a central longitudinal plane of the cylinder housing through the cylinder opening, a pair of inlet valves disposed in the cylinder head and facing the cylinder opening at a second opposite side of the central plane, coolant flow openings formed in the cylinder housing and cylinder head, said coolant flow openings including coolant flow diversion structure in the cylinder head at the first side of the central plane, said coolant flow diversion structure disposed between said pair of outlet valves and extending in a plane transverse to said central longitudinal plane of the cylinder housing and said coolant flow diversion structure disposed substantially perpendicular to a flow of coolant operable to accelerate flow of coolant toward a hot site in a coolant flow channel wall occurring during operation of the engine.

2. An engine assembly according to claim 1, wherein the hot site is located between the spark plug and the flow diversion structure.

3. An engine assembly according to claim 2, wherein the flow diversion structure includes a guiding rib.

4. A cylinder head for a water-cooled internal combustion engine with at least one hot spot caused by radiant heat of a combustion chamber on one wall of the cylinder head wherein the hot spot is cooled by a cooling channel through which cooling water flows, comprising:

a control structure disposed in the cooling channel for controlling a flow of cooling water and for controlled cooling of the at least one hot spot of the cylinder head, the at least one hot spot located in a vicinity of a spark plug or in a wall bordering the combustion chamber;

wherein the cooling channel forms a cross-current in the cooling water within the cylinder head and wherein the control structure takes effect adjacent to the at least one hot spot, the control structure formed by at least one guide rib in the cooling channel;

and wherein the guide rib extends in a plane transverse to a central longitudinal plane of the cylinder head and in the cooling channel between a first and a second outlet valve of the combustion chamber.

5. The cylinder head of claim 4, wherein the cooling water flows from an outlet side to an inlet side in the cooling channel.

* * * * *